US010900676B2

(12) United States Patent
Swanson et al.

(10) Patent No.: US 10,900,676 B2
(45) Date of Patent: Jan. 26, 2021

(54) COMPACT DEHUMIDIFIER

(71) Applicant: Premium Home Comfort, Inc., Philadelphia, PA (US)

(72) Inventors: Kurt Michael Swanson, Philadelphia, PA (US); Devin Sidell, Swarthmore, PA (US)

(73) Assignee: Premium Home Comfort, Inc., Philadelphia, PA (US)

( * ) Notice: Subject to any disclaimer, the term of this patent is extended or adjusted under 35 U.S.C. 154(b) by 92 days.

(21) Appl. No.: 16/180,640

(22) Filed: Nov. 5, 2018

(65) Prior Publication Data

US 2019/0137121 A1 May 9, 2019

Related U.S. Application Data

(60) Provisional application No. 62/581,902, filed on Nov. 6, 2017.

(51) Int. Cl.

| | |
|---|---|
| ***F24F 3/14*** | (2006.01) |
| ***F24F 13/22*** | (2006.01) |
| ***F25B 39/02*** | (2006.01) |
| ***F25B 39/04*** | (2006.01) |

(52) U.S. Cl.

CPC ..... *F24F 3/1405* (2013.01); *F24F 13/222* (2013.01); *F25B 39/02* (2013.01); *F25B 39/04* (2013.01); *F24F 2003/1446* (2013.01); *F25B 2339/04* (2013.01); *F25B 2500/01* (2013.01); *F25B 2500/18* (2013.01)

(58) Field of Classification Search

CPC ..... F24F 3/14; F24F 3/1405; F24F 2003/144; F24F 2003/1446; F25B 39/02; F25B 39/04; F25B 2339/02; F25B 2339/04; F25B 2500/01; F25B 2500/18

See application file for complete search history.

(56) References Cited

U.S. PATENT DOCUMENTS

| | | | | |
|---|---|---|---|---|
| 2,369,511 A * | 2/1945 | Winkler | F24F 1/022 62/288 |
| 2,630,691 A * | 3/1953 | Harris | F24F 1/022 62/288 |
| 5,117,651 A * | 6/1992 | Suh | F24F 1/0358 62/288 |
| 2006/0255164 A1 | 11/2006 | Oppermann et al. | |
| 2015/0184875 A1 | 7/2015 | Lee | |

FOREIGN PATENT DOCUMENTS

| | | |
|---|---|---|
| CN | 103398425 | 11/2013 |
| CN | 205372829 | 7/2016 |
| WO | 2017048012 | 3/2017 |
| WO | 2017057928 | 4/2017 |

* cited by examiner

*Primary Examiner* — Marc E Norman
(74) *Attorney, Agent, or Firm* — Volpe Koenig

(57) ABSTRACT

A dehumidifier is provided, the dehumidifier includes a housing, and a condenser and an evaporator arranged inside of the housing that are each formed into a generally circumferentially extending C shape and arranged to be generally coaxial and aligned with one another. A compressor and a fan are each centrally located in the housing, with the fan located above the compressor. A collection pan is located under the evaporator, and a water tank is located above the condenser, evaporator, and the compressor. A pump is provided to direct the collected water to the water tank.

18 Claims, 16 Drawing Sheets

COMPACT DEHUMIDIFIER

INCORPORATION BY REFERENCE

The following documents are incorporated herein by reference as if fully set forth: U.S. Provisional Application No. 29/581,902, filed Nov. 6, 2017.

FIELD OF INVENTION

This application is generally related to dehumidifiers, and more particularly related to a dehumidifier that is compact and offers enhanced ergonomic features.

BACKGROUND

Dehumidifiers are a packaged HVAC appliance designed to reduce the relative humidity of a room. Known dehumidifiers include a contained evaporator, condenser, compressor, a fan for motivating air over the heat exchangers, and a vessel for holding the condensate water until it can be removed by the user or pumped to a desired drain location. Many dehumidifiers have a hygrostat or humidistat which allows the user to prescribe a desired relative humidity for the space occupied by the appliance. Consumers use dehumidifiers in environments where the sensible air temperature may be comfortable or suitable to their needs, but where high relative humidity may cause poor comfort conditions, air quality issues, persistent odors, may be detrimental to objects in storage or building materials, or may allow the growth of microbes which present a health hazard. The most common application for a dehumidifier is the conditioning of air in a home basement where moist conditions may not be properly addressed by the HVAC system in the house, or where no HVAC system is present.

For operation of a dehumidifier, air is drawn or blown by a fan over the evaporator, which contains cold, low-pressure saturated refrigerant which absorbs enthalpy from the air passing over the coil. The temperature of this refrigerant is below the dew point of the air in the room, and as the air is drawn over the coil, water vapor from the air condenses on the coil on the evaporator heat exchanger, reducing the water vapor content in the air. This cold air exits the evaporator, and is blown over the condenser of the system, which allows the super-heated vapor expelled by the compressor to the condenser to be condensed by the cold air exiting the evaporator, at least partially reheating the air flow. This air is then blown past the compressor and fan motor(s) for the purpose of cooling these components. The water vapor condensate from the evaporator drains from the evaporator into a holding vessel, where it can be drained or pumped to a desired location.

There are several significant limitations of current dehumidifiers. The known dehumidifiers use gravity to allow the water to drip from the evaporator heat exchanger into a pan or bucket at the bottom of the appliance. While reducing the mechanical complexity of the device, this is problematic for the user. The bucket may not be in a position easily seen, so the user will have difficulty ascertaining how full the bucket is from afar. Second, the user must bend down and remove the bucket from the appliance. This is problematic because it may be difficult for users with poor mobility, and poor ergonomic features mean that the capacity of the bucket must be kept small enough to allow users of wide strength capabilities to remove and empty the bucket by hand. Because the bucket opening must be open on top to facilitate the draining of the water into the bucket, it can cause sloshing of the water when removed by the user, which may allow water to spill out of the bucket onto the floor or the user. Also, the open top is structurally suboptimal, making the bucket difficult to handle from the sides. These attributes mean that the total bucket volume must be kept low to allow the user to extract the water, which increases the frequency with which users must manually empty the bucket.

The currently known dehumidifiers often use a float or scale to switch off the appliance once the vessel is full, but offer no way to alert the user with the exception of a light or other local signal. Some dehumidifiers offer a pump to allow the user to keep from manually needing to empty the bucket, but not all have a pump included in the appliance. However, the majority of users would significantly benefit from owning a pump-based system to reduce the amount of time the system is turned off due to the bucket being full.

A typical dehumidifier contains a rectangular prismatic evaporator, often a fin and tube arrangement, mounted against a rectangular condenser of equal cross-sectional area located parallel to and in-line with the evaporator. Behind that, a fan drives air through the system and out into the room. A grill is placed over the fan outlet to prevent ingress of a user's finger or other articles. This configuration is simple and straightforward to design and manufacture. The grill, while important to user safety, is suboptimal for the visual aesthetics of the system and results in visual intrusiveness of the design.

Further, the electrical efficiency of a dehumidifier is important not only to users who must pay electrical bills, but also to energy policy regulators who must manage power use of the entire national or local grid. The dimension of the heat exchanger that has the most significant effect on the efficiency of the heat exchanger is the frontal, cross-sectional area measured by the area of the heat exchanger normal to the direction of airflow over the heat exchanger, often referred to as the "face area". Air pressure, caused by the viscous losses of air as it passes over the heat exchanger, is approximately proportional to the square of the velocity of the air over the heat exchanger face area. Therefore the face area of the heat exchanger has a significant effect on the amount of air a fan may deliver through a heat exchanger. Furthermore, additional face area adds more surface area between the condenser heat exchanger and the air working fluid, which the largest source of thermal resistance in the heat exchanger system. In a larger heat exchanger, each unit volume of air becomes more effective at reducing the condensing temperature of the fluid inside. In the case of dehumidifiers, because a single fan typically draws air over the both the evaporator and condenser in series, the pressure drop of these two heat exchangers is additive and additional face area must be employed to keep fan working pressures low, and fan power and noise to a minimum. This is problematic because the efficiency of the system of the system is directly tied to the visual aspects of the system. Big, flat heat exchangers are visually intrusive, and because the evaporator must be completely over the bucket, add to the height of the system.

SUMMARY

The present solution to the prior art needs provides an arrangement of dehumidifier components in a space efficient assembly and a housing that facilitates that space efficient assembly.

The present dehumidifier provides an arrangement in which a vessel for water collection is located on the top of the appliance for easy visual assessment by the user, and leverages the aesthetic beauty of the water to create a design that attracts the user. The water vessel in this invention contains a hole in the center of the appliance which serves several purposes. This hole acts as a chimney to allow the discharge air from the appliance fan to exit, but without the visual intrusiveness of a visible grill. The hole in the center also reduces the total volume of water to a reasonable mass so that even though visually it can be approximately half the height of the appliance, it can be lifted by nearly any user without concern for strength. To improve the ergonomics of the design, the hole also hides a set of two handles inside the chimney. The diameter of the hole can be controlled to ensure that the visible portion of the water on the exterior matches an aesthetically desirable ratio as compared to the base of the unit.

Experimentation has shown that the top handle allows the user to grasp the vessel with a strong grip at the center of the mass. Additionally, the location of the handle high on the vessel allows for easy, precision emptying of the vessel. As an additional improvement, pouring holes are located on the outside of the vessel on each side, parallel to the handle grip. This allows a user to precisely empty the water into a desired drain location, such as a sink or toilet, from either side, while the remaining hole acts as a vent which allows the pour water to be replaced by air without a vapor lock ("glug") which can cause splashing. The water pours out of the top as a precise, controlled stream. All of these improvements allow the vessel to be larger than the comparable known dehumidifier vessels.

Further, due to its ergonomic features, the total mass of the water tank can be increased to reduce the frequency with which the user must manually empty, and reduce the discomfort of bending over to access the water vessel.

A second handle below the first handle allows the user to pick up the dehumidifier itself, and move the appliance around the home as necessary without detaching the water tank on top. The second handle is integral to the chimney of the appliance, which is structurally fastened to the base of the appliance. The chimney itself conceals the condensate pump tube which runs to a spout near the top of the chimney and near the top of the condensate vessel, allowing the condensate to fill the vessel from the top and allow a well-sealed bottom to the water tank. The chimney further acts to conceal a wired sensor which measures when the water has filled the vessel to the maximum allowable height in the condensate vessel. If the sensor detects that the water height has reached its maximum allowable, it will shut off the dehumidification process. This also signals the controller to send a signal to the user, preferably via smartphone app or other notification scheme that the water tank is ready to be emptied.

The bottom of the chimney contains a single axial or mixed flow fan attached to a fan motor. This fan draws air from the center of the condenser system. Additionally, the compressor is centrally located within the middle of the dehumidifier.

In the preferred configuration, the condenser is bent or formed into a cylindrical or otherwise primarily wrapped configuration, and is located about the compressor. Outside of that, the evaporator has a similarly formed curved or otherwise primarily wrapped configuration and extends generally concentric to the condenser to form a substantially larger heat exchanger. Because the evaporator is made wet by the condensing water vapor, the pressure drop induced by the wet coil can be minimized due to its increased size in comparison to the condenser. Dehumidification operating at low ambient temperature (below 45 degrees F.) may require the use of a frosting evaporator, whereby the saturation temperature of the refrigerant in the evaporator is below freezing. This allows the coil to ice over, at which point the compressor is stopped and the ice is allowed to thaw and drain. In the case of the present dehumidifier, this larger evaporator also permits fewer cycles of freezing and thawing, and larger volumes of water to be condensed with each freezing cycle. The direction of airflow may be reversed if conditions warrant it, where air ingested through the top, the inner heat exchanger is then the evaporator, and the outer heat exchanger is then the condenser. This may be a more suitable configuration when energy efficiency is a more important consideration than low temperature operation, by allowing the condenser to be larger, and for a given volume of airflow, the condensing saturation pressure of the condenser to be lower, and therefore less compressor power is needed.

The use of a curved or bent condenser and evaporator radially located around the compressor allows a volumetrically compact design for a given set of heat exchanger face areas. It also allows a visually smaller appliance, which is beneficial to the user in cramped spaces where a dehumidifier may be most warranted, without compromising performance or latent capacity. By allowing for a larger set of heat exchangers for a similar volume, the present design also permits the use of lower pressure and power fans, which can also reduce the noise that many users experience based on the previously known designs.

A base pan is located below the evaporator and condenser, which allows a small volume of water to pool until it becomes warranted to run the condensate pump. The condensate pump discharges to two possible locations—the tank at the top of the appliance, or to a discharge port that allows the user to run a hose to a desired drain location, such as a sump pump, french drain, or out of a window. The user can switch the valve to determine where this discharge water goes.

The appliance may be connected via WiFi or some other network connectivity to permit the user to remotely control the hygrostat setting of the appliance, as well as other operation modes.

The appliance may also contain a sensor on the bottom to detect water on the exterior of the device. Because dehumidifiers are often used in basements or other places where water is prevalent, there is also a risk of the user experiencing a flood in the room. The water source which causes the high humidity also increases risk of flooding or water in the space occupied by the appliance. The sensor may be attached to a semi-permanent installation on the bottom surface of the appliance so that if water rises in the room, the sensor is triggered and activates an auditory or other local alarm, and may also send a signal to the user via WiFi or other messaging protocol that there is a potential property damage event occurring in the room occupied by the appliance. Alternatively, the sensor, attached by some length of coiled wire, may be removable and place in a location more desirable to the user, such as the area just around or at the top of a sump or drain area, so that the warning may occur at some level below which property damage occurs. The sensor signals when water is detected, and communicates this information to the power board. The dehumidifier can be turned off at this point for improved safety. A relay inside the air conditioner could be used to trip the GFI or LCDI cable to prevent electricity in the dehumidifier from causing a danger to the user or a fire risk during flooding.

In the case of the present dehumidifier, the use of a WiFi, internet connected device allows the user to be notified by app or text message that their vessel is full, so that they are aware that the dehumidification process is paused.

BRIEF DESCRIPTION OF THE DRAWINGS

The following detailed description of the preferred embodiments of the present application will be better understood when read in conjunction with the appended drawings. For the purpose of illustrating the invention, there is shown in the drawings embodiments that are presently preferred. It should be understood, however, that the inventions are not limited to the precise arrangements shown in the drawings.

DETAILED DESCRIPTION OF THE PREFERRED EMBODIMENTS

Figure 1:
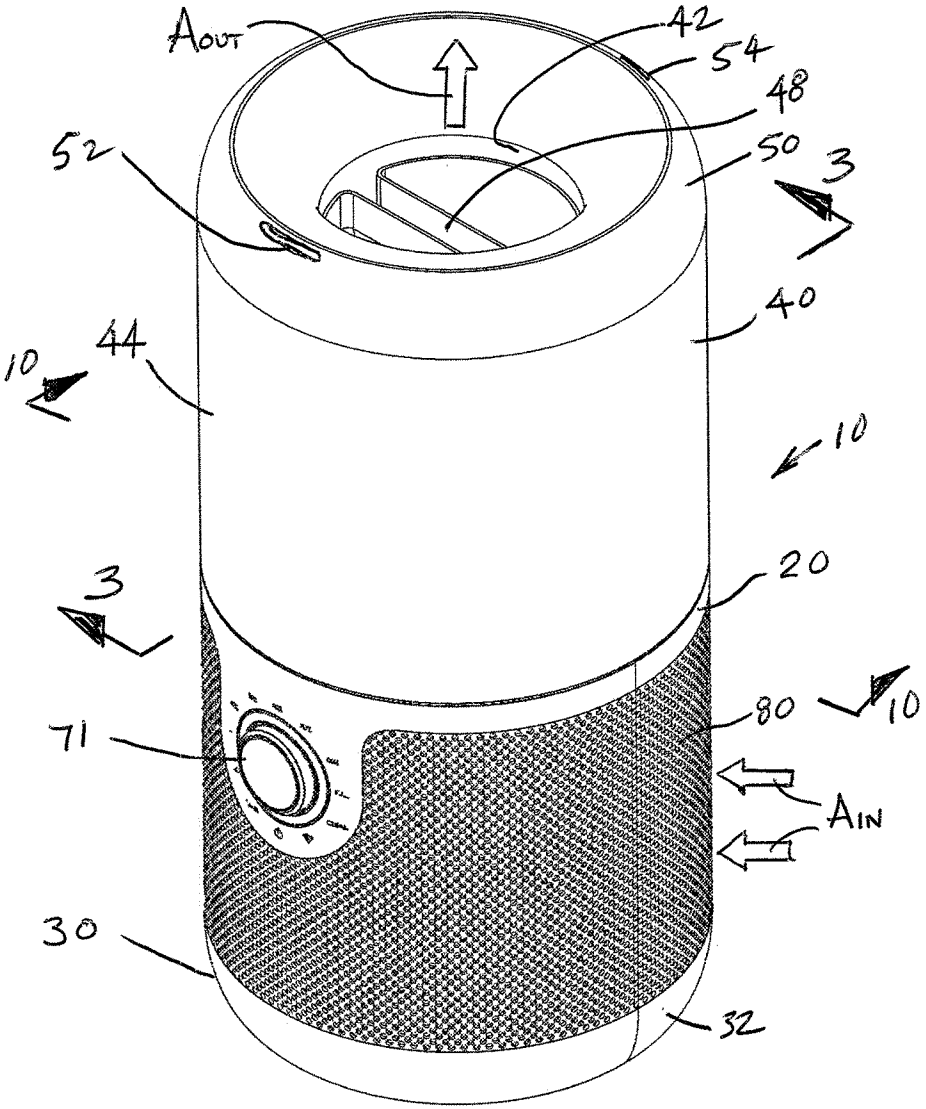
FIG. 1 is a perspective view of one embodiment of a dehumidifier.
Figure 2:
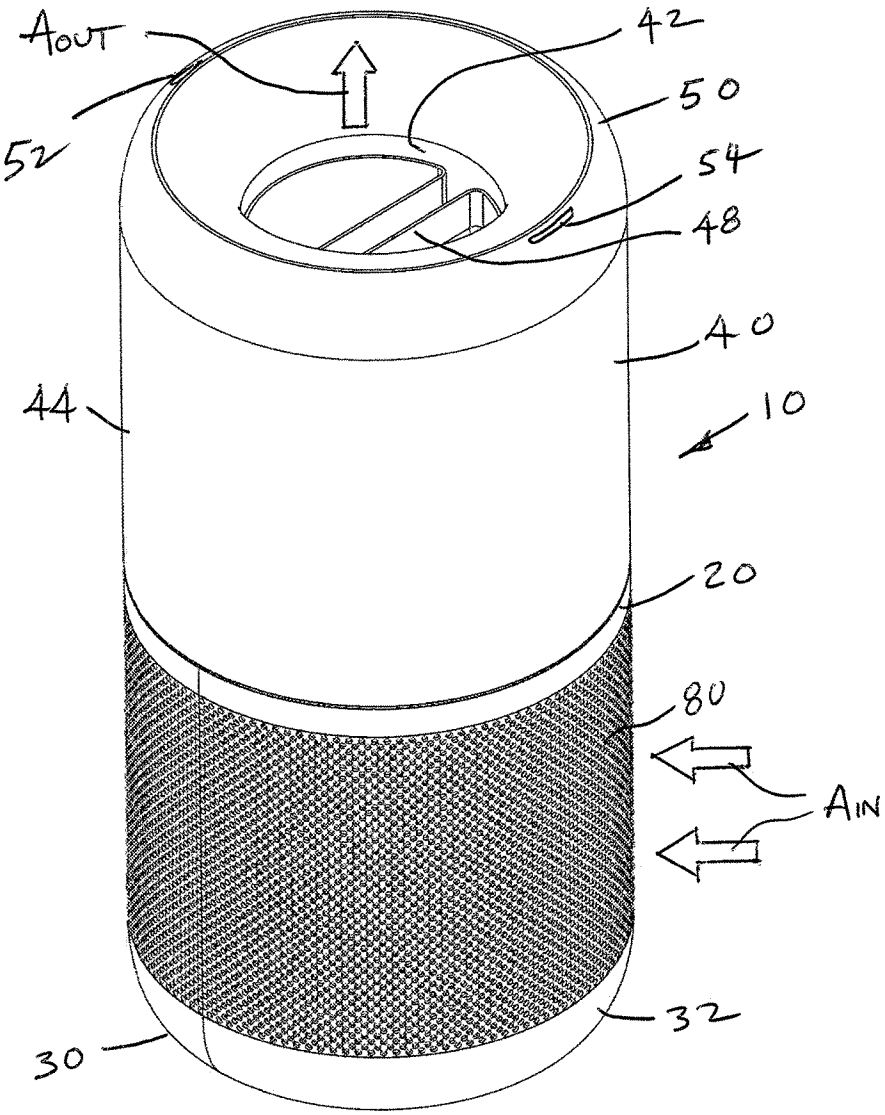
FIG. 2 is a perspective view showing the back of the dehumidifier shown in FIG. 1.

Certain terminology is used in the following description for convenience only and is not limiting. The words "front," "back," "top," "bottom," "inner," "outer," "upper," "lower," "internal," and "external" designate directions in the drawings to which reference is made. The words "upward," "downward," "above," and "below" refer to directions towards a higher or lower position from the parts referenced in the drawings. The words "inward" and "outward" refer to directions towards an inner or outer portion of the element referenced in the drawings. The words "clockwise" and "counterclockwise" are used to indicate opposite relative directions of rotation, and may be used to specifically refer to directions of rotation about an axis in accordance with the well-known right hand rule. Additionally, the terms "a" and "one" are defined as including one or more of the referenced item unless specifically noted otherwise. A reference to a list of items that are cited as "at least one of a, b, or c" (where a, b, and c represent the items being listed) means any single one of the items a, b, or c, or combinations thereof. The terminology includes the words specifically noted above, derivatives thereof, and words of similar import.

Figure 3:
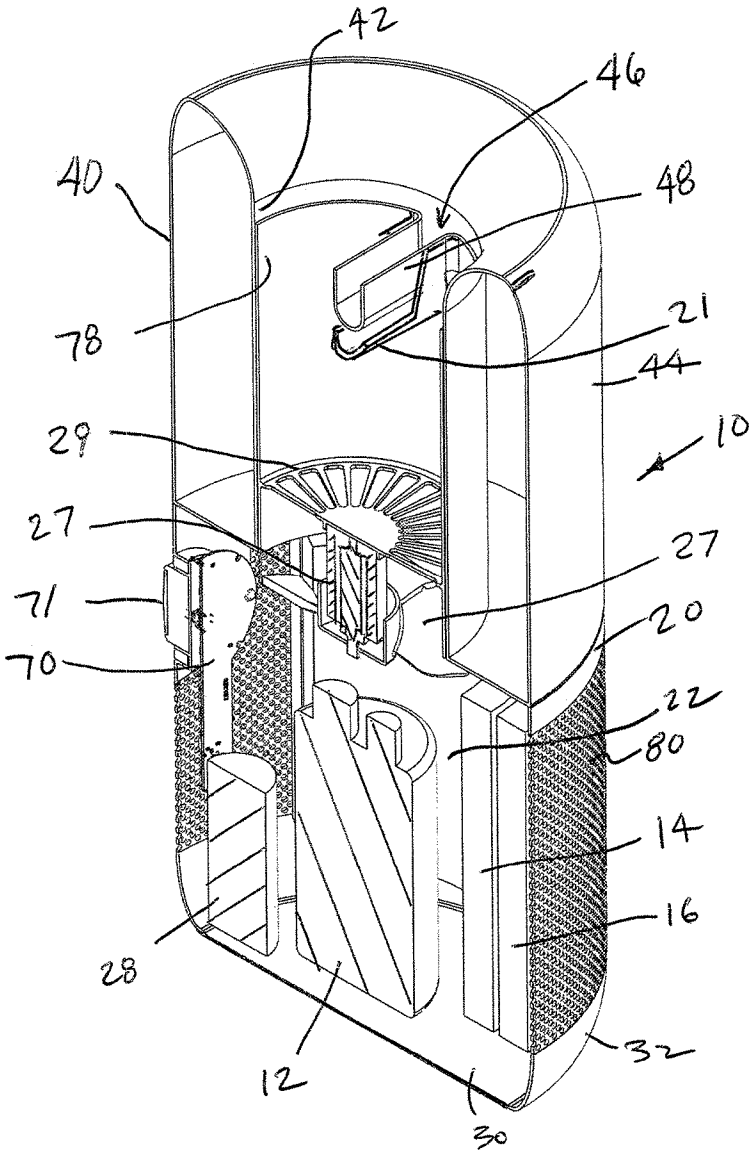
FIG. 3 is a cross-sectional view through the dehumidifier shown in FIG. 1 taken along lines 3-3 in FIG. 1.
Figure 4:
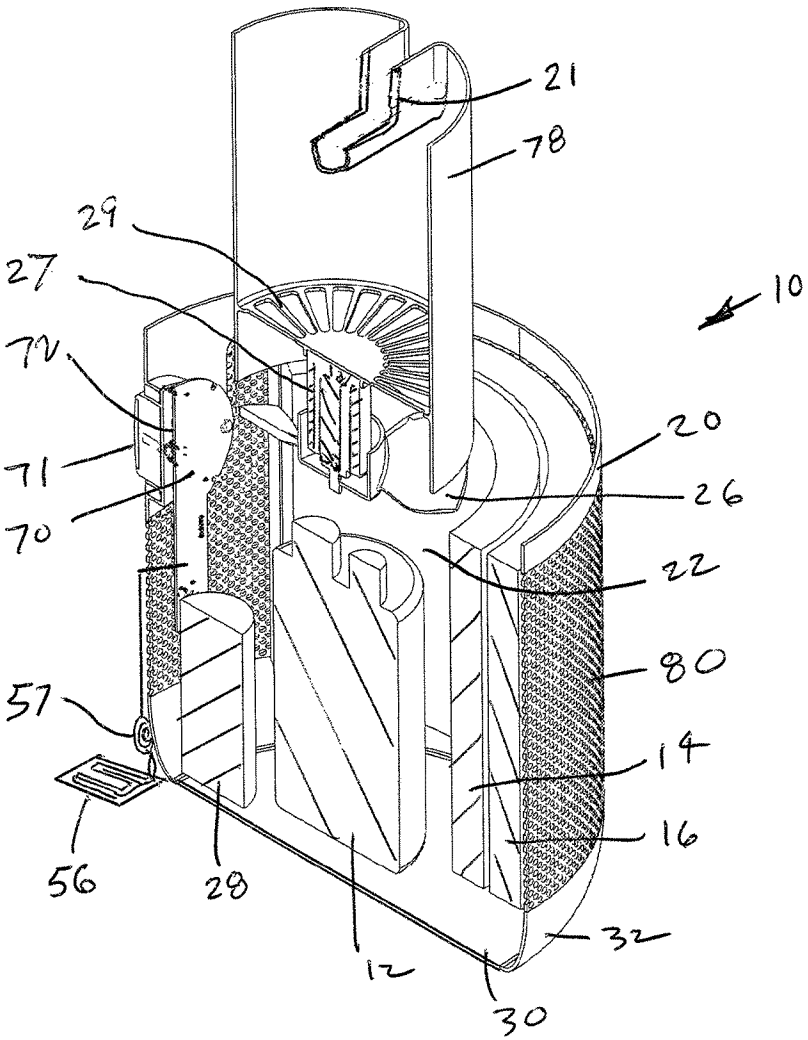
FIG. 4 is a cross-sectional view similar to FIG. 3 with the water tank removed.

The present application includes a description of a dehumidifier 10 which more efficiently utilizes a given space and provides for more ergonomic handling. FIGS. 1 through 16 show exemplary components of the dehumidifier 10 arranged to provide a more compact arrangement of parts as well as more convenient and ergonomic usage. In an exemplary embodiment, the dehumidifier 10 includes a compressor 12, a condenser 14, and an evaporator 16 arranged inside of a housing 20, as shown in FIGS. 3 and 4. The compressor 12 is centrally located in the housing 20 of the dehumidifier 10 and is connected to the condenser 14 which is further connected to the evaporator 16 via a throttling device or expansion valve 18 by tubing 24A, 24B, 24C (illustrated schematically in FIGS. 5 and 7 and omitted in the other figures for ease of view). A fan 26 is centrally located above the compressor 12. A water tank 40 that is adapted to receive the collected water is located at a top portion of the housing 20.

In order to improve functionality, the dehumidifier 10 utilizes a collection pan 32 at a base 30 of the housing 20 that is located at least under the evaporator 16, and a pump 28 that directs the collected water from the collection pan 32 to the water tank 40 or out through a drain line.

The compressor 12 is located within a central area 22 defined by the evaporator 16 and the condenser 14, as shown in FIGS. 3-7. With respect to the compressor 12, one of ordinary skill in the art will appreciate that there are many different types of compressors, including without limitation rotary compressors, piston compressors, and electrolytic compressors, any of which may be used with the present air conditioner. Furthermore, a variety of coolants having the requisite heat transfer characteristics may be used in the present dehumidifier 10, including without limitation coolants that undergo phase transitions as it circulates throughout the system, which are common known as refrigerants. In an embodiment of the present dehumidifier 10 where a thermoelectric heat pump is used in place of the compressor 12, the coolant does not circulate between the evaporator 16 and the condenser 14, but rather is separately contained in the evaporator 16 and the condenser 14 individually. For purposes of the present application, the reference to a "refrigerant" is used for convenience only, and does not limit the specific coolant that may be used to a known AC refrigerant or a coolant that undergoes phase transitions, and instead may refer broadly to any coolant or heat transfer fluid that is capable of being circulated to transfer heat between components of the present dehumidifier 10, including coolants that keep its phase or the use of solid materials as coolants.

The condenser 14 and the evaporator 16 are arranged inside of the housing 20. The condenser 14 and the evaporator 16 are each formed with a continuous bend or a series of bends into a generally circumferentially extending shape that extends preferably at least about 225°. The term generally circumferential refers to a shape that extends in the circumferential direction about a central axis, and can be formed as a continuous curve that forms a "C" shape, or a plurality of serially arranged straight segments that are joined at an angle to each other to approximate a curved shape, with preferably 5 or more segments set at angles of 60° or less relative to one another to form a polygonal shape with an open section at least between the first and last segments to also generally form a "C" shape. The evaporator 16 and the condenser 14 are generally coaxial and aligned with one another.

The evaporator 16 preferably includes evaporator piping or tubing that coils through the body, preferably in a serpentine path so as to maximize the path of the refrigerant that flows through the tubing and the evaporator. The body of the evaporator 16 is a heat exchanger, which includes a plurality of fins that may be formed out of a material having good heat transfer properties, such as a highly thermally conductive metal such as aluminum or copper. One of ordinary skill in the art would appreciate that there are a variety of shapes, such as pins, straight fins, or flared fins suitable for heat sink fins. The body of the evaporator 16 may be further configured to include what is commonly known as "offset interrupted fins" or "louvered fins." In the offset interrupted fins configuration, each "fin" or "plate" of the evaporator body includes a plurality of slits (the "interruptions") that are generally placed close together at regular intervals. As airflows along the radial direction between two fins of the evaporator body, the air enters and exits the plurality of slits/interruptions formed in the fins, which increases heat transfer and causes the airflow to become turbulent, thus ensuring that the cooled air immediately mixes with the surrounding air. To further optimize performance of the evaporator 16 and increase heat transfer, the material between adjacent slits/interruptions in the fins may be stamped to create an "offset," adjacent offsets being stamped in opposite directions. The offsets interrupt the boundary condition of the airflow and further increase air turbulence, which improves the heat transfer capabilities of the evaporator. In the louvered fins configuration, the offsets are at an angle, and adjacent offsets are formed with opposing angles, so that air flowing through one offset out through a slot is forced to change angles before entering an adjacent slot to flow through the next offset, once again increasing turbulence and improving heat transfer.

The fins of the evaporator 16 and condenser 14 heat exchangers are preferably formed from a material having good heat transfer properties, and may be arranged vertically such that air may flow between adjacent fins. The fins are very thin and are arranged vertically along the body of the condenser 14 to maximize the surface area of the fins as external air is blown through the body of the condenser 14 to cool down the refrigerant or other coolant circulating through the condenser tubing.

The refrigerant that exits the compressor 12 is in a high-pressure hot gaseous state, and flows through the condenser 14 within the condenser tubing. The body of the condenser 14 is a heat sink having a plurality of fins, which may be arranged like the fins in the evaporator 16 and configured as "offset interrupted fins" or "louvered fins."

Figure 5:
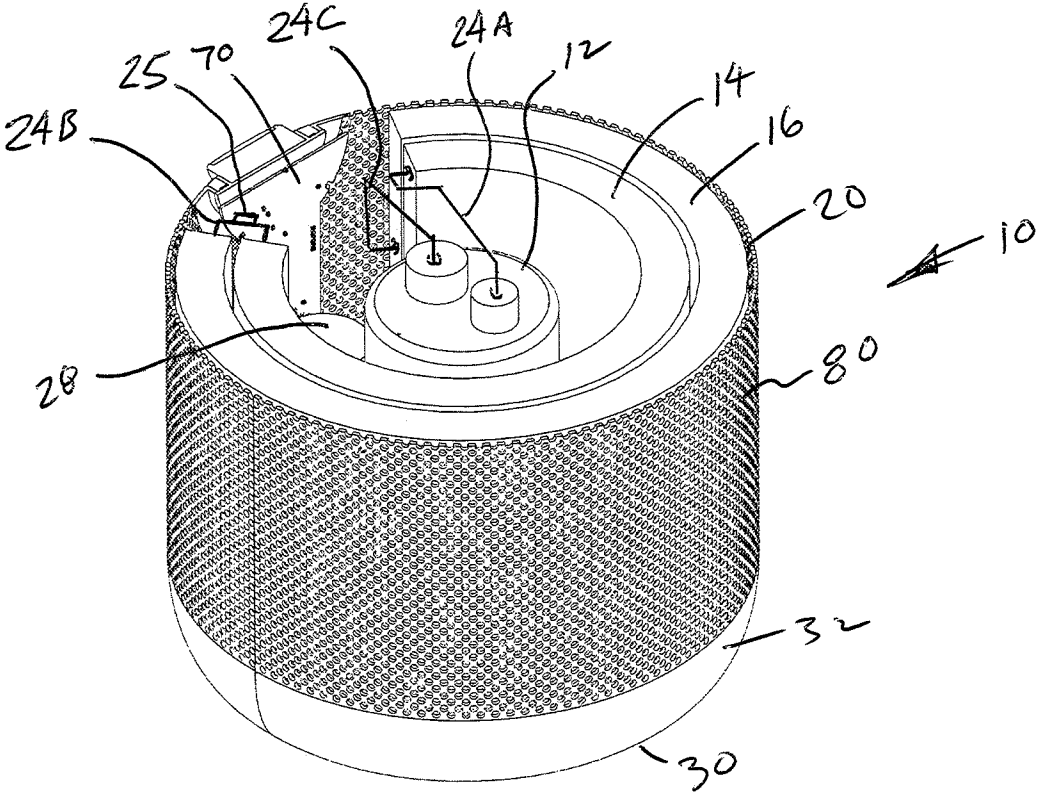
FIG. 5 is a perspective view of the dehumidifier showing the lower section of the housing along with the compressor, evaporator, and condenser.
Figure 7:
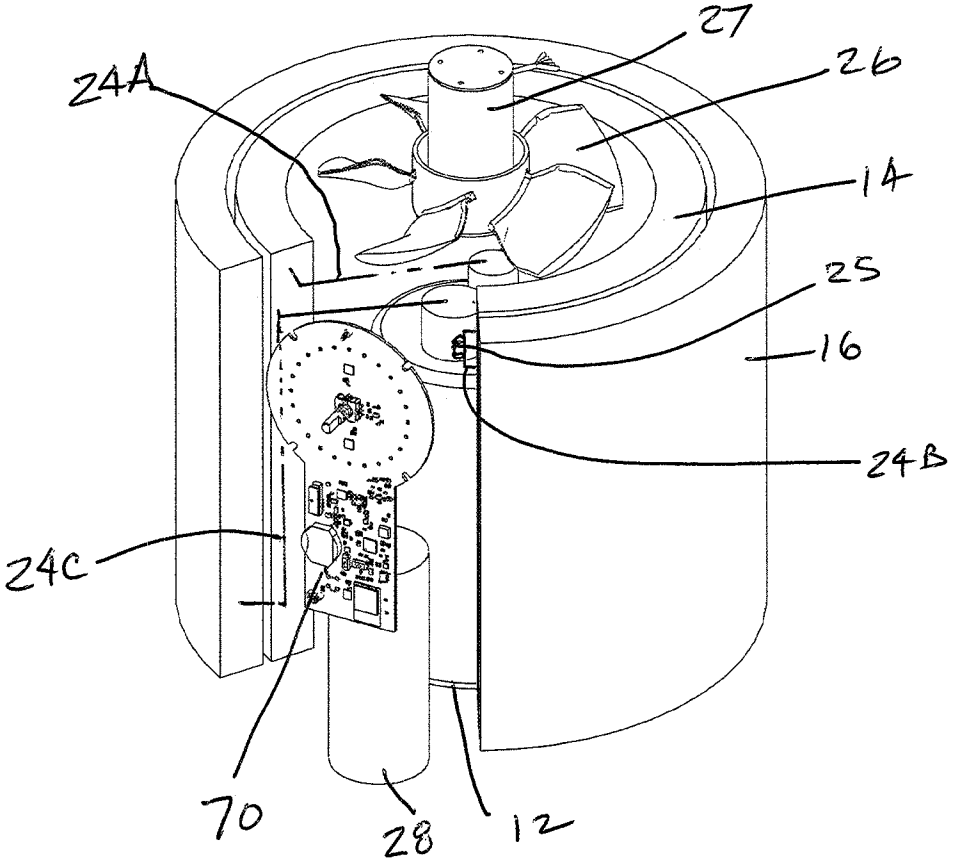
FIG. 7 is a perspective view showing the compressor, condenser, evaporator, fan, and water pump used in the dehumidifier of FIG. 1.
Figure 8:
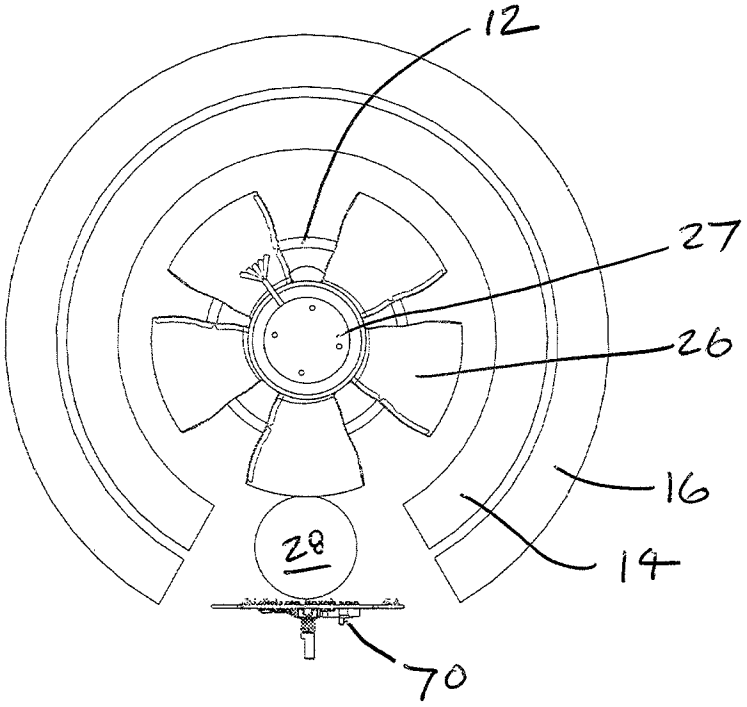
FIG. 8 is a view looking down on the arrangement of the components shown in FIG. 7.
Figure 9:
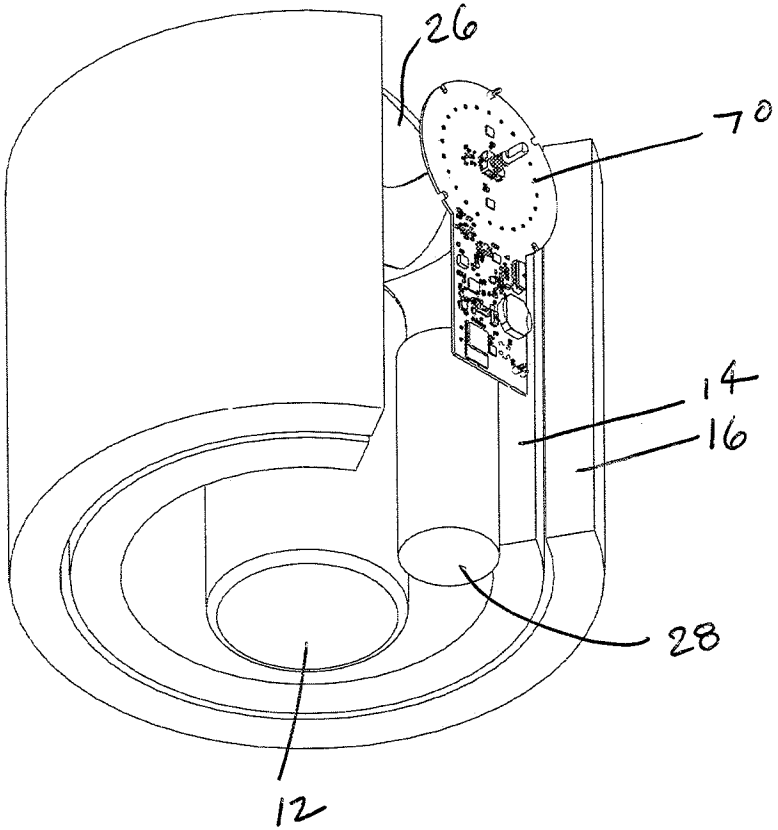
FIG. 9 is a perspective view looking up at the components shown in FIG. 7.

The connection tubing 24B shown schematically in FIGS. 5 and 7 may be associated with the evaporator tubing and the condenser tubing to allow for the flow of refrigerant from the condenser 14 to the evaporator 16. The connection tubing 24B may be coiled in a serpentine path, and further includes a throttling device or expansion valve 25, which may be for example and without limitation a capillary expansion valve. The expansion valve 25 quickly decreases the cross-sectional flow area of the connection tubing and thus drops the pressure of the refrigerant flowing out of the condenser 14, which changes the state of the refrigerant form a high-pressure hot liquid to a low-pressure cold boiling liquid. The compressor 12 may be associated with the evaporator 16 and condenser 14 through a series of connection tubes 24A, 24C, shown schematically in FIGS. 5 and 7, which are preferably arranged in a coiled configuration so as to act as a spring between the compressor 12 and the rest of the components in the air conditioner 10. By acting as a spring, the compressor tubing mechanically isolates the compressor 12 from the evaporator 16 and condenser 14, which is desirable because the compressor 12 can cause a large amount of vibration during operation, which may damage the other components if not isolated. Where a thermoelectric heat pump is used in place of a compressor, the connection tubing between the evaporator 16 and condenser 14 is not required, as the coolant remains within the evaporator tubing and condenser tubing separately. In such an embodiment the thermoelectric heat pump is thermally associated with and arranged between the evaporator 16 and the condenser 14, such that the cold side of the thermoelectric heat pump is thermally associated with the evaporator to cool the coolant contained in the evaporator tubing, while the hot side of the thermoelectric heat pump is thermally associated with the condenser to transfer heat into the coolant contained in the condenser tubing. In such an arrangement, the evaporator and condenser tubing may each be formed as a heat pipe, which is well known heat transfer device, and the coolant used may be, for example and without limitation, a liquid such as methanol or acetone.

The fan 26 is shown in detail in FIGS. 3, 4, and 6-8. The fan 26 has a motor 27 and is located within the housing 20 centrally above the compressor 12 to generate an intake airflow Ain through the evaporator 16 to remove moisture from the airflow Ain and then through the condenser 14 to at least partially reheat the air prior to discharging dehumidified air, indicated as Aout.

Figure 6:
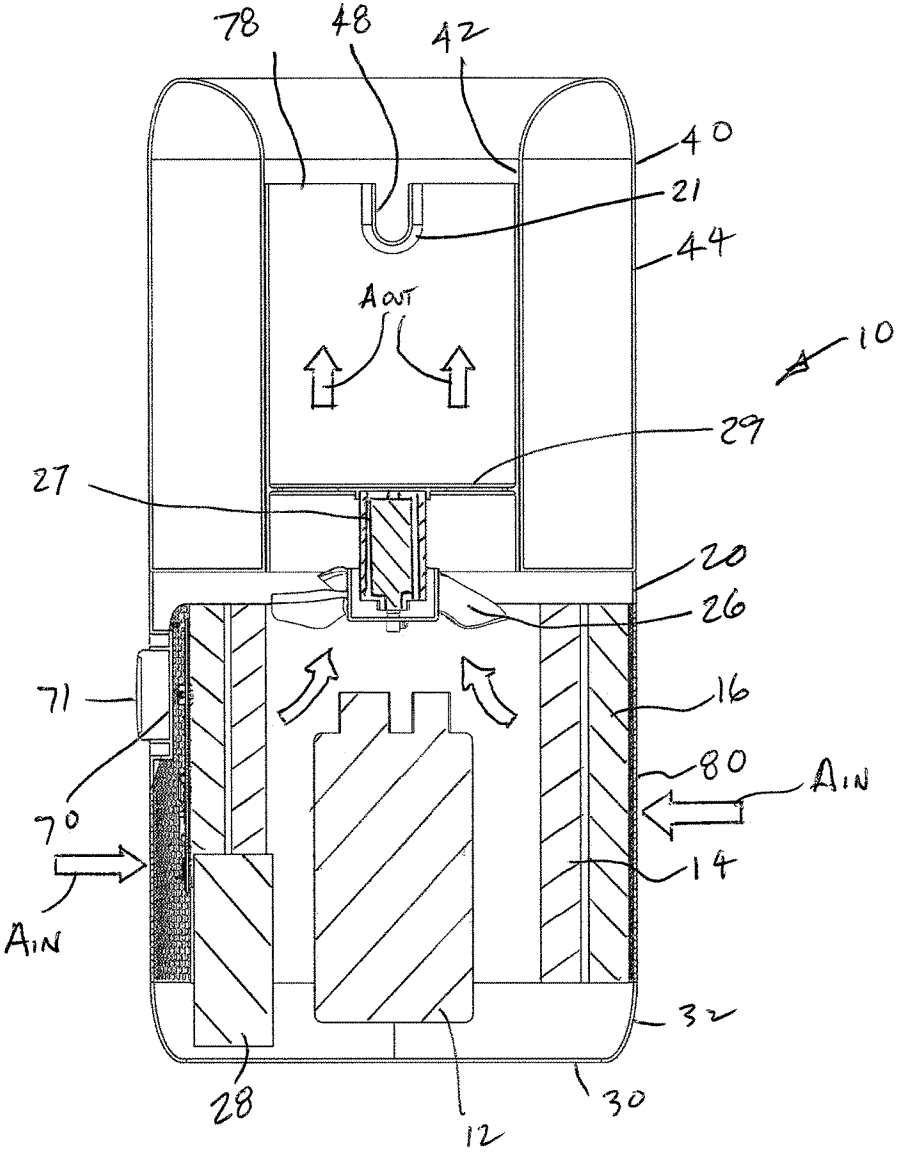
FIG. 6 is a cross-sectional view of the dehumidifier similar to FIG. 3.

The housing is shown in detail in FIGS. 1-10 and includes a base 30 that forms part of a collection pan 32. Above the base 30 is a perforated sidewall 80, preferably formed by a punch sheet or mesh, which generally surrounds the area of the evaporator 16 and the condenser 14. A central chimney portion 78 extends upwardly from a center region of the housing 20 and includes a grate 29 located above the fan 26. This defines an outflow path for the discharged dehumidified air Aout, as shown in FIG. 6. As shown in FIGS. 11-16, the chimney can include longitudinally extending grooves on one or both sides to accommodate the tank water level sensor 76 as well as the tank feed tube 36, discussed in further detail below. The collection pan 32 extends at least under the evaporator 16 and preferable beneath the entire area of the housing 20.

Figure 15:
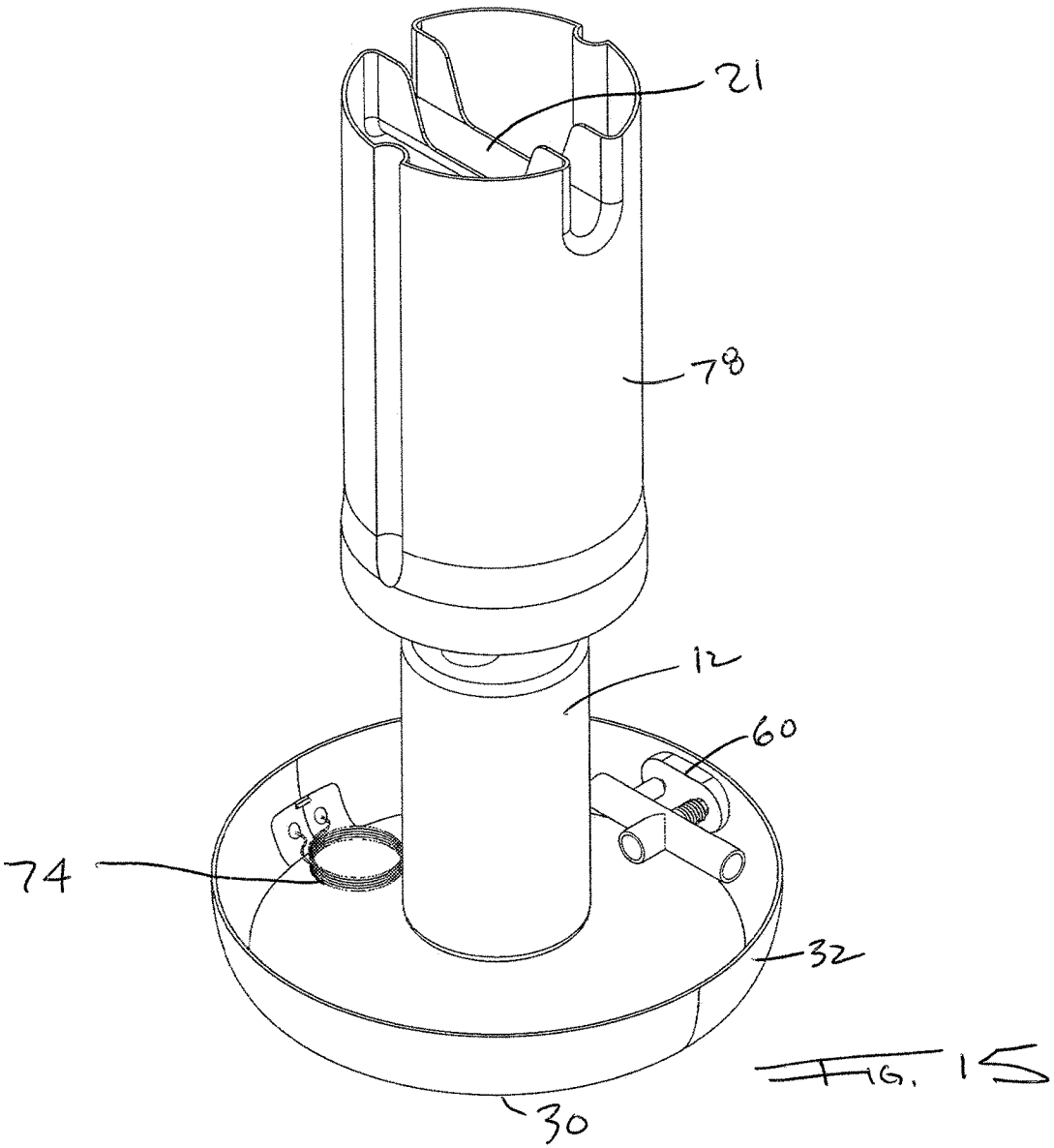
FIG. 15 is a perspective view showing the collection pan at the bottom of the housing and the centrally arranged compressor and chimney portion of the housing.
Figure 16:
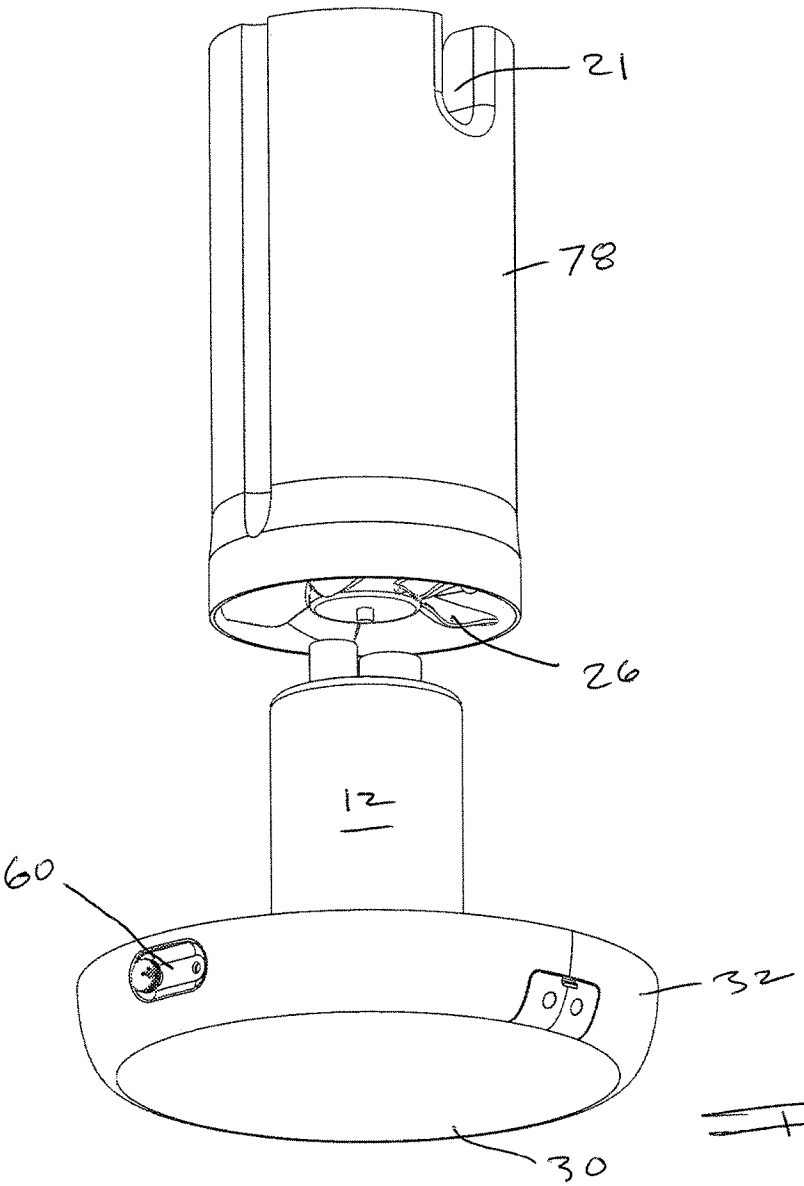
FIG. 16 is a perspective view similar to FIG. 15.

As shown in detail in FIG. 15, the housing 20, and preferably the chimney portion of the housing 20, includes a handle 21 that extends across the chimney portion around which the outflowing air Aout flows.

Referring again to FIGS. 1-3, 6, and 9, a water tank 40 is located above the condenser 14, the evaporator 16, and the compressor 12. The water tank 40 has an annular shape and includes an inner wall 42 and an outer wall 44 preferably connected by an annular bottom. The inner wall 42 defines a central open region 46 and is complementary to an outside of the chimney 78 so that the water tank 40 can be securely positioned on the housing 20. The water tank 40 also includes a handle 48 at a top 50 thereof that extends across the central open region 46. Preferably, the water tank 40 includes two openings 52, 54 located at the top of the outer wall 44 on opposite sides of the water tank 40. Here, one of the two openings 52, 54 can act as a vent and the other of the two openings 52, 54 acts as a pour spout to allow water collected in the water tank to be discharged in a smooth and efficient manner. Preferably, the top 50 of the water tank 40 is closed aside from the two openings 52, 54. As shown in detail in FIG. 10, the water tank handle 48 is adapted to nest into the handle 21 of the housing 20 when the water tank 40 is located on the housing 20. This nested arrangement allows for easier lifting and carrying of the entire dehumidifier 10 by a user reaching and gripping under the handle 21 in order to move the entire unit. However, if only the water tank 40 is to be drained, then the space between the water tank handle 48 and the housing handle 21 allows for a user to merely engage the water tank handle 48 in order to remove it from the housing 20 to drain the water. Preferably, the water tank 40 is configured to be lifted vertically for separation from the housing 20 which prevents spilling and allows for easier handling given that the water tank handle 48 is located at the top 50 of the water tank 40, preventing spillage as well as allowing for engaging the water tank handle 48 while the user is in a more upright position rather than having to slide a tray out from beneath the evaporator as in the prior known designs.

Preferably the water tank is made of molded polymeric material. However, it could be made from other materials, if desired.

Referring now to FIG. 4, a detachable water sensor 56 may be located on the base 30 of the housing 20. This can be connected to the bottom edge of the base 30 via a removable adhesive or other type of mechanical attachment. The detachable water sensor 56 is movable from a first operating position where it is connected to a base 30 to a second operating position where it is spaced apart from the base 30. This is preferably accomplished via a connection wire 57 connected to the sensor 56 that can be uncoiled to allow for placement of the water sensor 56 away from the base 30. The water sensor 56 is connected to the controller 70 for the dehumidifier, which is described in further detail below.

In order to move water that is collected by the evaporator 16 and drips into the collection pan 32 to the water tank 40, a pump 28 is provided as shown in detail in FIGS. 3, 4, 6-9, and 11-14. The pump 28 preferably collects water from the collection pan 32 and directs the collected water to the water tank 40 via one or more tubes 34, 36 that lead from the pump 28 and discharge via the tank feed tube 36, shown in FIG. 13, into the water tank 40.

In a preferred arrangement, a selectable discharge valve 60 is connected to the pump 28 via one of the tubes 34 and allows a user to select whether the collected water from the collection pan 32 is pumped into the water tank 40 or pumped out through an auxiliary drain line connected at 62.

Figure 10:
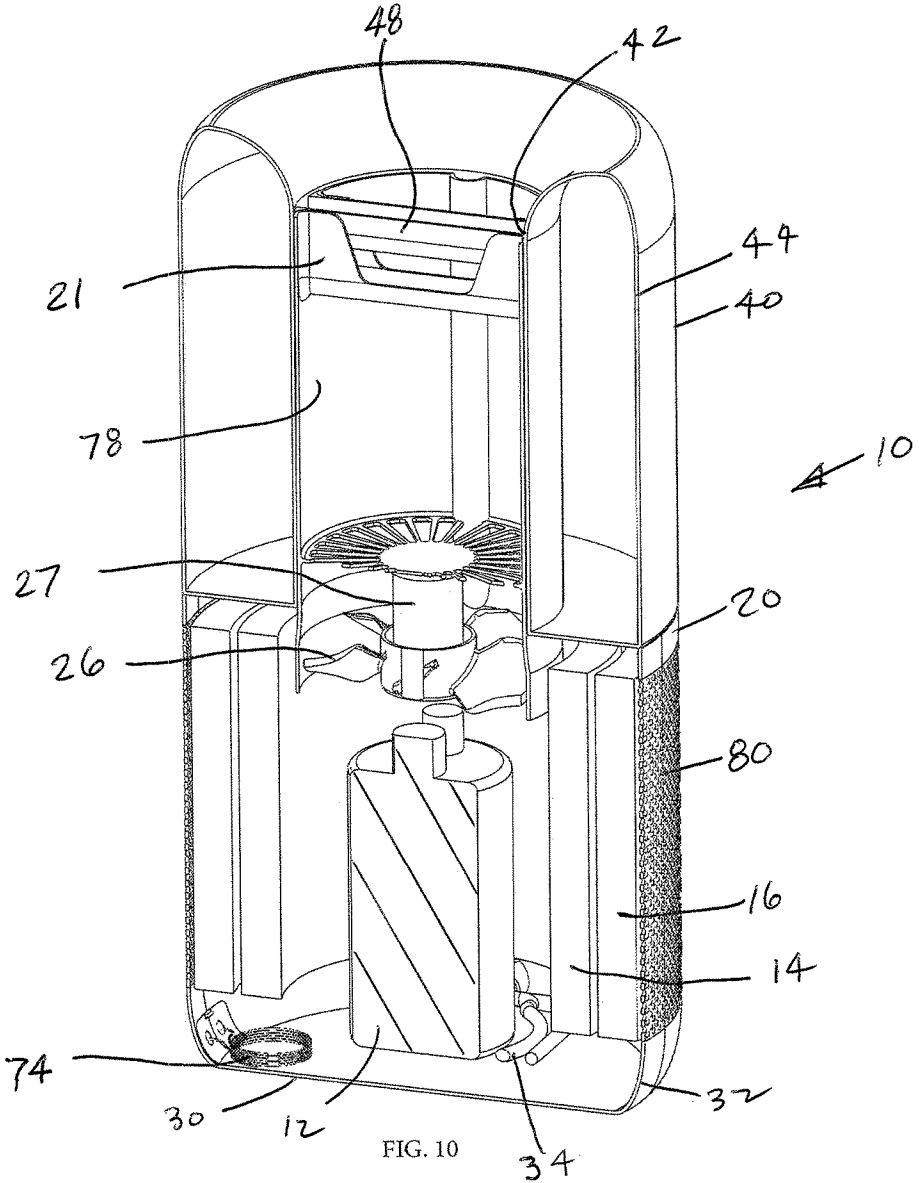
FIG. 10 is a cross-sectional view taken along line 10-10 in FIG. 1.

A pan sensor 74, shown in FIG. 10 is preferably located in the collection pan 32 and signals the controller 70 when water has accumulated in the pan 32 to a predetermined level and the controller 70 then turns on the pump 28 in order to either direct the collected water to the water tank 40 or out to the drain line 62, depending upon the position of the selectable discharge valve 60.

Referring to FIGS. 3-5, and 7, the controller 70, which is preferably an IC base controller that includes a memory that can be programmed, is connected to a hygrostat 72 and the compressor 12 in order to control an on-off cycle of the dehumidifier 10. The humidity level can be set using a control knob 71 that extends on the outward face of the housing 20. A unit on-off switch can also be incorporated in the knob 71 or provided by a separate switch. The controller 70 is also connected to the detachable water sensor 56 as well as the pan sensor 74. In the event that the water sensor 56 detects a leak, the controller 70 can sound an alarm and will wirelessly provide an alarm signal to the user, for example via WiFi to an App on the user's phone or other internet connected device.

Figure 11:
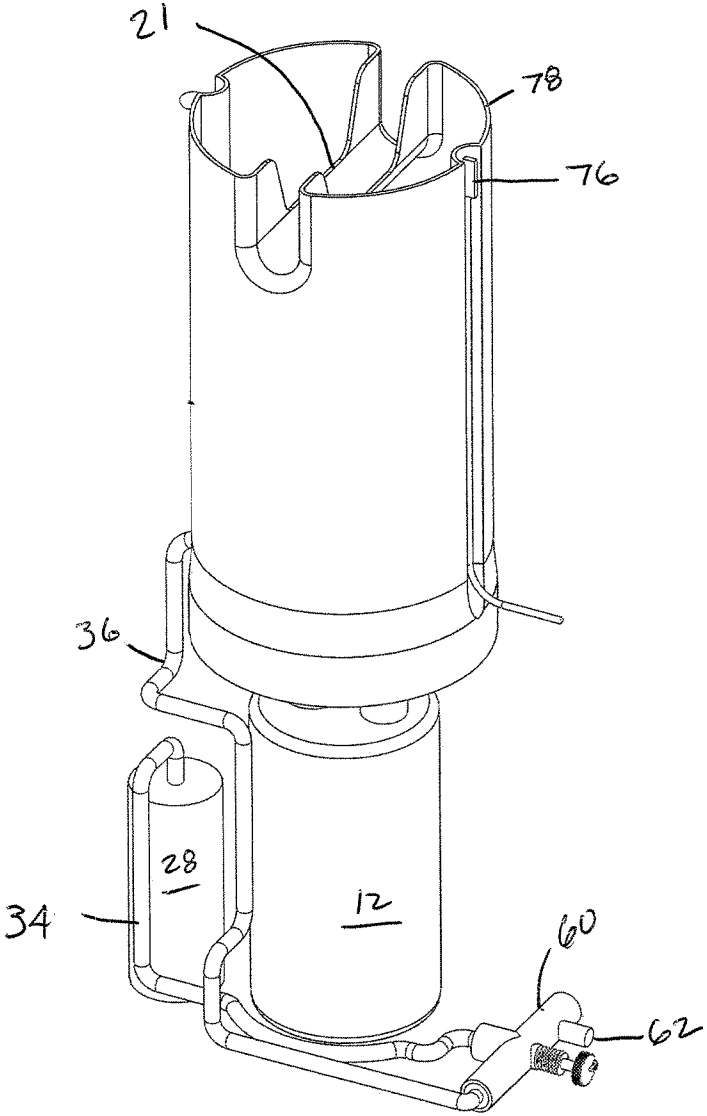
FIG. 11 is a perspective view showing the chimney portion of the housing arranged above the compressor and the pump.
Figure 12:
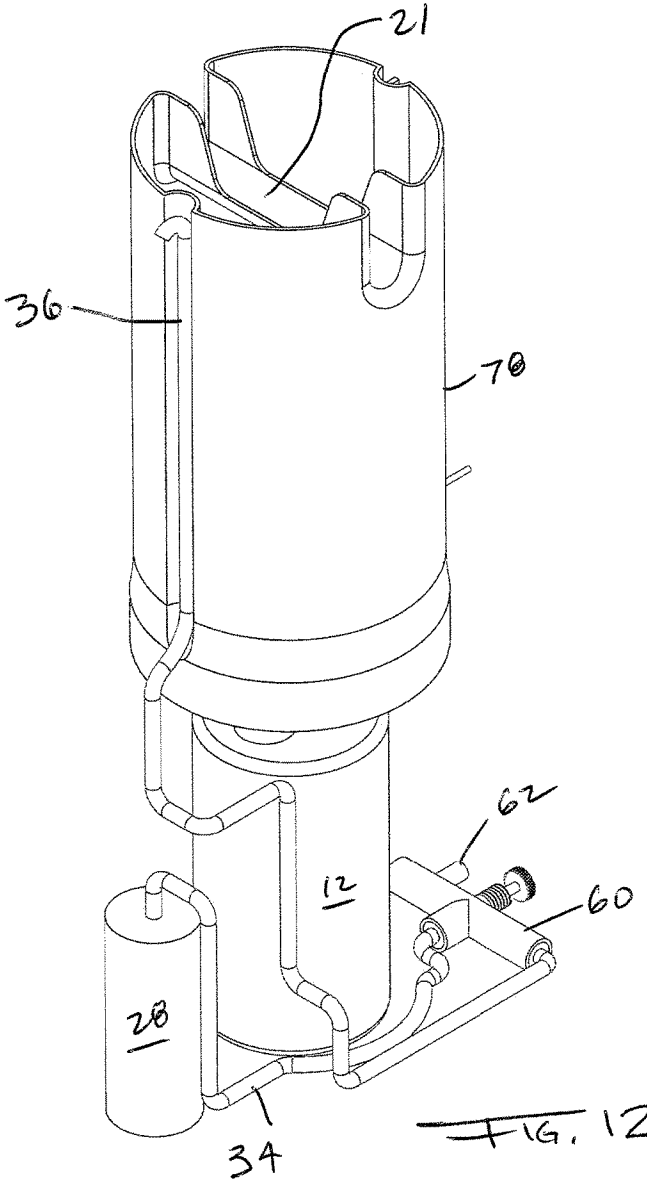
FIG. 12 is a perspective view similar to FIG. 11 showing the chimney arranged above the compressor along with the pump and a transfer valve.
Figure 13:
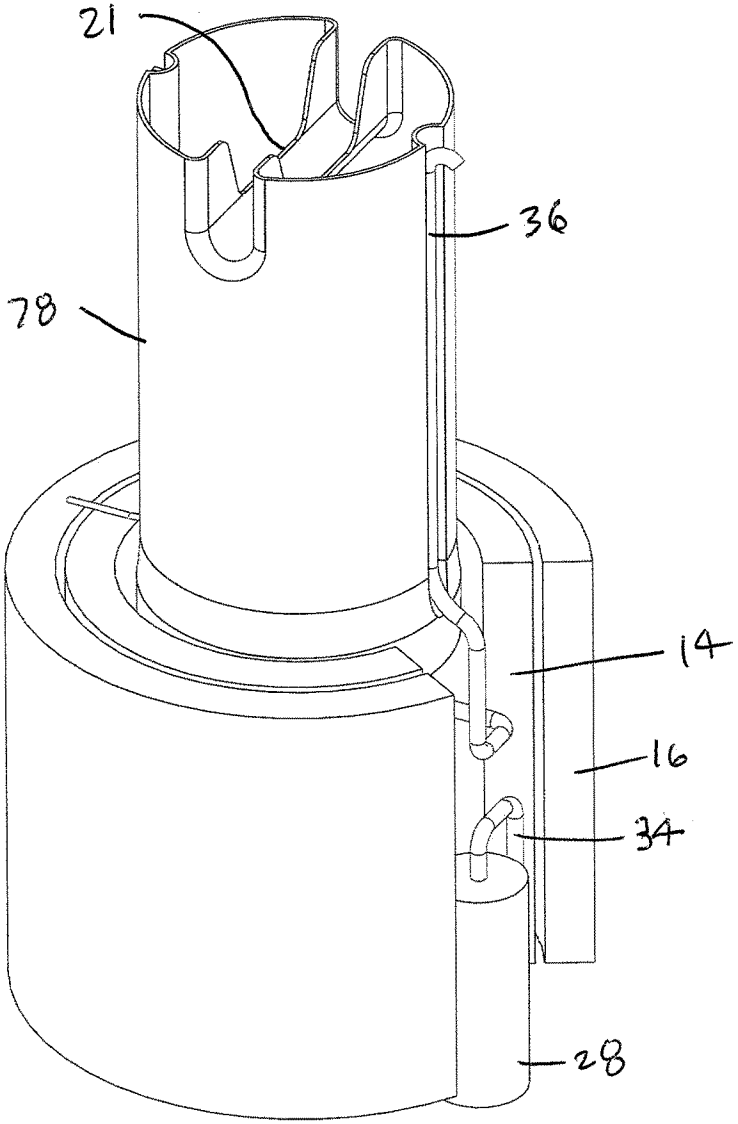
FIG. 13 is a perspective view showing the chimney portion of the housing extending above the condenser and evaporator.
Figure 14:
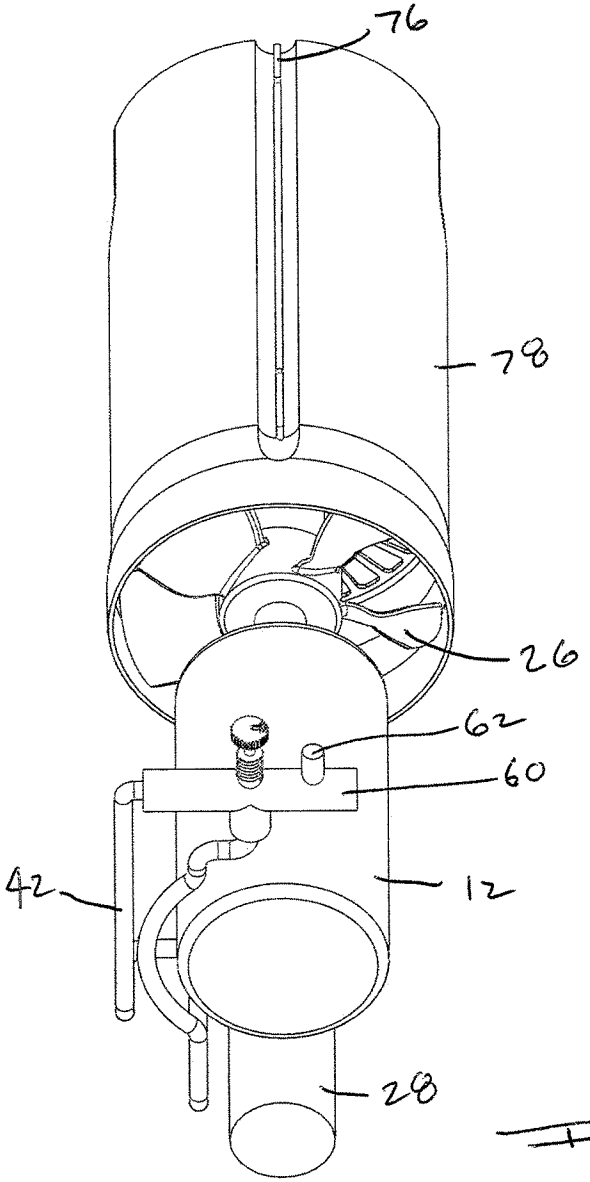
FIG. 14 is a perspective view looking up at the components shown in FIG. 11.

As shown in FIG. 11, a tank water level sensor 76 is provided that is adapted to detect a water level in the tank 40. The tank water level sensor 76 is also connected to the controller 70 which is configured to turn off the dehumidifier 10 if the water level in the water tank 40 reaches a predetermined level. Again, the controller 70 can provide a warning indicator when the water level in the tank 40 reaches a predetermined level and can also wirelessly send a signal to the user, for example, via WiFi or other wireless connection to an internet connected device.

In the preferred arrangement, the evaporator 16 is located radially outside of the condenser 14, and the fan 26 draws the intake airflow Ain through the perforated sidewall 80, the evaporator 16, and the condenser 14, and then directs the dehumidified air out through the central chimney 78. However, those skilled in the art will recognize that other arrangements could be utilized where the position of the evaporator and the condenser are reversed and the airflow is also reversed.

The preferred arrangement provides the housing 20 and the water tank 40 in the form of a generally cylindrical shape. However, this could be varied and a polygonal shape could be provided depending upon the particular aesthetics desired. Additionally, the water tank 40 is preferably in a range of about 40% to 60% of the overall height of the dehumidifier 10.

Based on the ergonomic design of the dehumidifier 10, the total mass of the water tank 40 when full can be increased in order to reduce the frequency with which the user must manually empty the water tank 40. This is because the water tank is located at the top of the dehumidifier 10 rather than in the previously known position which provided a removable collection and drainage pan or bucket beneath the evaporator that had to be slid out from under the evaporator in order to be drained. By allowing a user to grip the water tank 40 via the handle 48 located at the top 50, this also reduces the discomfort to the user who is previously required to bend over in order to access the water vessel.

While the fan 26 is preferably a single centrifugal fan in the preferred arrangement, those skilled in the art will recognize that multiple fans could be used.

In use, air Ain is drawn in and is cooled by the relatively colder surfaces of the fins of the evaporator 16 due to the cold boiling liquid refrigerant flowing through the evaporator tubing, causing water to condense on the evaporator 16. The thermal energy (i.e. heat) from the air Ain is transferred into the refrigerant that flows through the evaporator tubing of the evaporator 16, which is in turn warmed from a low-pressure cold boiling liquid into a low-pressure cold gas as the refrigerant flows from the evaporator 16 back to the compressor 12 to be pressurized and heated. Preferably, an accumulator is provided to ensure that any liquid left in the refrigerant is removed before the refrigerant enters the compressor 12, so as not to damage the compressor 12 when the gaseous refrigerant is pressurized and heated. The compressed and heated refrigerant is then sent through the condenser 14 where the cooled and dehumidified radially inward airflow Ain that has passed through the evaporator 16 is at least partially reheated, removing heat from the refrigerant in the condenser 14. The fan 26 then discharges the air upwardly and out of the housing 20 as indicated at Aout.

One of ordinary skill in the art would appreciate that various aesthetic changes may be made to the present dehumidifier 10 without departing from the inventive features and components discussed herein.

Accordingly, even though the figures in the present application show embodiments utilizing a certain combination of motors and fans, and specific arrangement of the horizontally mounted compressor with respect to the fans, such configurations should not be interpreted as being a limitation on the present invention.

LIST OF ELEMENT NUMBERS

10 Dehumidifier
12 Compressor
14 Condenser
16 Evaporator
20 Housing
21 Housing handle
22 Central area
24A, B, C Tubing
25 Expansion valve or throttling device
26 Fan
27 Fan motor
28 Pump
29 Grate
30 Base of housing
32 Collection pan
34 Water tube
36 Tank feed tube
40 Water tank
42 Inner wall
44 Outer wall
46 Central open region
48 Handle
50 Top
52 Opening
54 Opening
56 Detachable water sensor
57 Sensor wire
60 Selectable discharge valve
62 Drain line connection
70 Controller
71 Control knob
72 Hygrostat
76 Water level sensor
78 Chimney
80 Perforated sidewall
Ain Airflow in
Aout Airflow out

What is claimed is:

1. A dehumidifier comprising:

a housing;

a condenser and an evaporator arranged inside of the housing, the condenser and the evaporator being formed with a continuous bend or a series of bends into a generally circumferentially extending C shape, and the evaporator and the condenser are generally coaxial and aligned with one another having substantially a same height and extending substantially a same angular distance circumferentially such that the openings defined by the C shape of the evaporator and condenser are aligned;

a compressor centrally located in the housing within a central area defined by the condenser and the evaporator and connected thereto to define a refrigerant path;

a fan centrally located above the compressor to generate an intake airflow through the evaporator to remove moisture from the airflow and then through the condenser to reheat the air prior to discharging dehumidified air;

a collection pan located at least under the evaporator;

a water tank located above the condenser, the evaporator and the compressor; and a pump that directs collected water to the water tank.

2. The dehumidifier of claim 1, wherein the water tank is annular and defines a central open region.

3. The dehumidifier of claim 2, wherein the water tank includes a handle at a top thereof that extends across the central open region.

4. The dehumidifier of claim 3, wherein the water tank is configured to be vertically lifted for separation from the housing.

5. The dehumidifier of claim 3, wherein the water tank includes two openings at the top located on opposite sides of the water tank, with one of the two openings acting as a vent and an other of the two openings acting as a pour spout.

6. The dehumidifier of claim 2, wherein the housing includes a handle that is located beneath the water tank handle while the water tank is located on the housing.

7. The dehumidifier of claim 1, further comprising a selectable discharge valve connected to the pump that directs the collected water to be pumped out through a drain line.

8. The dehumidifier of claim 1, further comprising a controller connected to a hygrostat and the compressor to control an on-off cycle of the dehumidifier.

9. The dehumidifier of claim 8, further comprising a water sensor connected to the controller to detect water leakage.

10. The dehumidifier of claim 8, further comprising a water level sensor that is adapted to detect a water level in the water tank, the water level sensor being connected to the controller which is configured to turn off the dehumidifier if the water level in the water tank reaches a predetermined level.

11. The dehumidifier of claim 10, wherein the controller is adapted to wirelessly signal a user that the water tank is full.

12. The dehumidifier of claim 1, wherein the housing includes a central chimney about which the water tank is located.

13. The dehumidifier of claim 12, wherein the housing comprises a perforated sidewall in an area of the evaporator and the condenser.

14. The dehumidifier of claim 13, wherein the evaporator is located radially outside of the condenser, and the fan draws intake airflow through the perforated sidewall, the evaporator, and the condenser, and directs the dehumidified air out through the central chimney.

15. The dehumidifier of claim 1, wherein the housing and the water tank form a cylindrical shape.

16. The dehumidifier of claim 1, wherein the fan is a centrifugal fan.

17. A dehumidifier comprising:

a housing;

a condenser and an evaporator arranged inside of the housing, the condenser and the evaporator being formed with a continuous bend or a series of bends into a generally circumferentially extending C shape, and the evaporator and the condenser are generally coaxial and aligned with one another;

a compressor centrally located in the housing within a central area defined by the condenser and the evaporator and connected thereto to define a refrigerant path;

a fan centrally located above the compressor to generate an intake airflow through the evaporator to remove moisture from the airflow and then through the condenser to reheat the air prior to discharging dehumidified air;

a collection pan located at least under the evaporator;

a water tank located above the condenser, the evaporator and the compressor;

a pump that directs the collected water to the water tank;

the housing includes a handle that is located beneath the water tank handle while the water tank is located on the housing; and the water tank handle is nested in the housing handle.

18. A dehumidifier comprising:

a housing;

a condenser and an evaporator arranged inside of the housing, the condenser and the evaporator being formed with a continuous bend or a series of bends into a generally circumferentially extending C shape, and the evaporator and the condenser are generally coaxial and aligned with one another;

a compressor centrally located in the housing within a central area defined by the condenser and the evaporator and connected thereto to define a refrigerant path;

a fan centrally located above the compressor to generate an intake airflow through the evaporator to remove moisture from the airflow and then through the condenser to reheat the air prior to discharging dehumidified air;

a collection pan located at least under the evaporator;

a water tank located above the condenser, the evaporator and the compressor;

a pump that directs the collected water to the water tank; and a detachable water sensor located on a base of the housing, the detachable water sensor being movable from a first operating position connected to the base, to a second operating position spaced apart from the base.

* * * * *